US005192090A

United States Patent [19]

Damborsky

[11] Patent Number: 5,192,090

[45] Date of Patent: Mar. 9, 1993

[54] SKI BINDING COMPONENT, PARTICULARLY A FRONT JAW

[75] Inventor: Klaus Damborsky, Klosterneuburg-Kierling, Austria

[73] Assignee: HTM Sport- und Friezeitgeraete Gesellschaft m.b.H., Schwechat, Austria

[21] Appl. No.: 768,274

[22] PCT Filed: Jan. 16, 1991

[86] PCT No.: PCT/EP91/00062

§ 371 Date: Sep. 27, 1991

§ 102(e) Date: Sep. 27, 1991

[87] PCT Pub. No.: WO91/11231

PCT Pub. Date: Aug. 8, 1991

[30] Foreign Application Priority Data

Feb. 5, 1990 [AT] Austria ..... 231/90

[51] Int. Cl.[5] ..... A63C 9/22

[52] U.S. Cl. ..... 280/634; 280/617; 280/618; 280/633

[58] Field of Search ..... 280/634, 633, 616, 617, 280/618

[56] References Cited

U.S. PATENT DOCUMENTS 4,681,339 7/1987 Himmetberger et al. ..... 280/633
5,056,808 10/1991 Klaus et al. ..... 280/633
5,085,453 2/1992 Bildner ..... 280/617

FOREIGN PATENT DOCUMENTS 3201319 7/1983 Fed. Rep. of Germany ..... 280/633
3714001 11/1987 Fed. Rep. of Germany ..... 280/617
8907475 8/1989 World Int. Prop. O. ..... 280/617
9111231 8/1991 World Int. Prop. O. ..... 280/633

*Primary Examiner*—Eric D. Culbreth
*Attorney, Agent, or Firm*—Flynn, Thiel, Boutell & Tanis

[57] ABSTRACT

A ski binding component, such as a front jaw, arranged movably in longitudinal direction of a ski on a ski-fixed guide rail and being releasably lockable in predetermined positions. To fix each chosen position of the ski binding component on the guide rail, a locking part with an operating member is provided and which is adjustable to two different elevational positions, which locking part is biassed by a spring. In order to be able to use such a ski binding component together with a heel holder connected by means of a metal band to the ski binding component, the invention provides that the operating member has three surfaces through which the locking part provides two defined locking positions. Thus, it is possible to adjust either the heel holder and the connected metal band relative to the front jaw or both the front jaw and the heel holder can be adjusted in longitudinal direction of the ski.

4 Claims, 3 Drawing Sheets

SKI BINDING COMPONENT, PARTICULARLY A FRONT JAW

FIELD OF THE INVENTION

The invention relates to a ski binding component, particularly to a front jaw.

BACKGROUND OF THE INVENTION

A ski binding component of this type is described in AT-PS 380 639. The technical solution disclosed in this reference has been successful, however, it has the disadvantage that the known locking device enables only two positions, namely a locked position and an unlocked position. However, there also exists the need to use a ski binding component of the above type in connection with such a complete ski binding in which a heel holder is coupled with the movable jaw unit by means of a metal band. It is thereby possible, on the one hand, to adjust in a longitudinal direction of the ski, and in a first unlocked position, the heel holder with the metal band relative to the front jaw and to thus adapt the distance between the front jaw and the heel holder to different ski boot sizes. On the other hand, the free adjustability of the front jaw according to the parent patent is also maintained in a second unlocked position. In addition, the entire ski binding with the inserted ski boot can, at the same time in this case, also be moved into a centered position relative to the ski and this position can then be fixed by a double locking of the locking device. The solution of this task is the subject matter of the present invention.

DE-OS 35 23 058 discloses already a solution by which safety ski bindings with simultaneous adjustment possibilities for the front jaw and the heel holder cannot only be adapted to different skiing conditions and snow conditions, but also where an adapting to different ski boot sizes is made possible. It was thereby suggested according to a first modification of DE-OS 35 23 058 that the locking device has a second lock which forms a voluntarily releasable connection between one of the binding parts and the connecting band, with the operating member having a second unlocking position influencing the second lock and with the first lock being associated with the connecting element.

Thus, it is possible to adjust the binding unit formed of a front jaw and a heel holder relative to the ski in a longitudinal direction of the ski when the first lock associated with the connecting band is unlocked.

To adjust to differently sized ski boots, the second lock is unlocked, which second lock determines the position of the front jaw relative to the connecting element.

However, an operating member in this known development can unlock only either the one or the other lock; a simultaneous movement of the binding parts is not possible. This means that only when the front jaw has been moved into a suitable position will it be possible, by a repeated operation of the operating member into the other direction, to effect a movement of the entire ski binding relative to the ski into the desired position in order to receive a specific ski boot size.

The second lock is constructed in one piece with the first lock in the second embodiment according to DE-OS 35 23 058 so that the front jaw, in the second unlocked position of the lock, is movable in a longitudinal direction of the ski relative to the lock. The distance between the existing two locks in the longitudinal direction of the ski, according to a first exemplary embodiment; no longer exists in this embodiment; however, also this technical measure changes nothing with respect to the above-mentioned disadvantageous manipulation. Rather a further disadvantage is created by this arrangement since the unlocked position of the lock relative to the guide rail of the front jaw can only occur in a downward direction, as this is disclosed in the description of FIGS. 5 and 6 of the mentioned reference. Thus, the front jaw must be mounted at a distance from the upper side of the ski, which distance corresponds with the operating path of the unified lock. This measure does not only result in an increased type of construction for the front jaw but also disadvantageously affects the dimension of the fastening screws.

SUMMARY OF THE INVENTION

A ski binding component, such as a front jaw, is supported for movement in a longitudinal direction of a ski on a guide rail adapted to be fixed to the ski. The ski binding component is releasably lockable in selected positions along the length of the guide rail. To fix each selected position of the ski binding component on the guide rail, a locking part with an operating member is provided and which is adjustable to three different elevational positions. The locking part is spring urged toward the upper surface of the ski. In order to be able to use such ski binding component together with a heel holder connected by means of a metal band to the ski binding component, the operating member has three surfaces through which the locking part provides two defined locking positions. Thus, it is possible to adjust either the heel holder and the connected metal band relative to the front jaw or both the front jaw and the heel holder can be adjusted in longitudinal direction of the ski.

Due to the fact that the operating member has according to the invention a third surface or a third surface section, it is possible for the locking member to be locked in two active positions on the guide rail. However, it is also guaranteed in this manner that, in a first unlocked position, the metal band with the heel holder by itself and, in a second unlocked position in addition, the jaw unit can also be adjusted in a longitudinal direction of the ski. It finally is possible to lock the front jaw and the heel holder together again in the desired, newly adjusted position which, for example, also considers the centered position of the entire binding relative to the ski.

The solution of the invention assures furthermore that the locking device requires neither in the construction length nor in the construction height undesired changes in dimensions of the individual parts or of the entire ski binding unit.

BRIEF DESCRIPTION OF THE DRAWINGS

The invention will be described in greater detail hereinafter in connection with the drawings which illustrate one exemplary embodiment.

DETAILED DESCRIPTION

Figure 1:
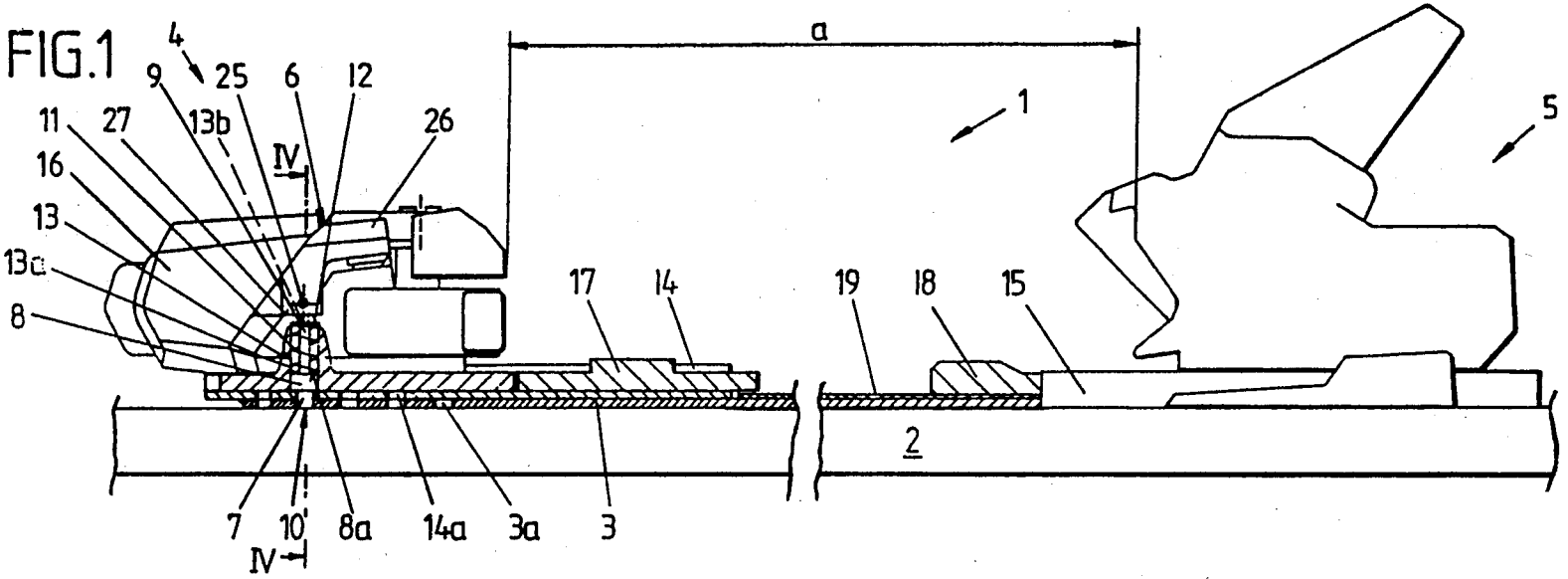
FIG. 1 is a vertical cross-sectional view taken along the line I—I of FIG. 4 and with a schematically illustrated heel holder in the skiing position.
Figure 2:
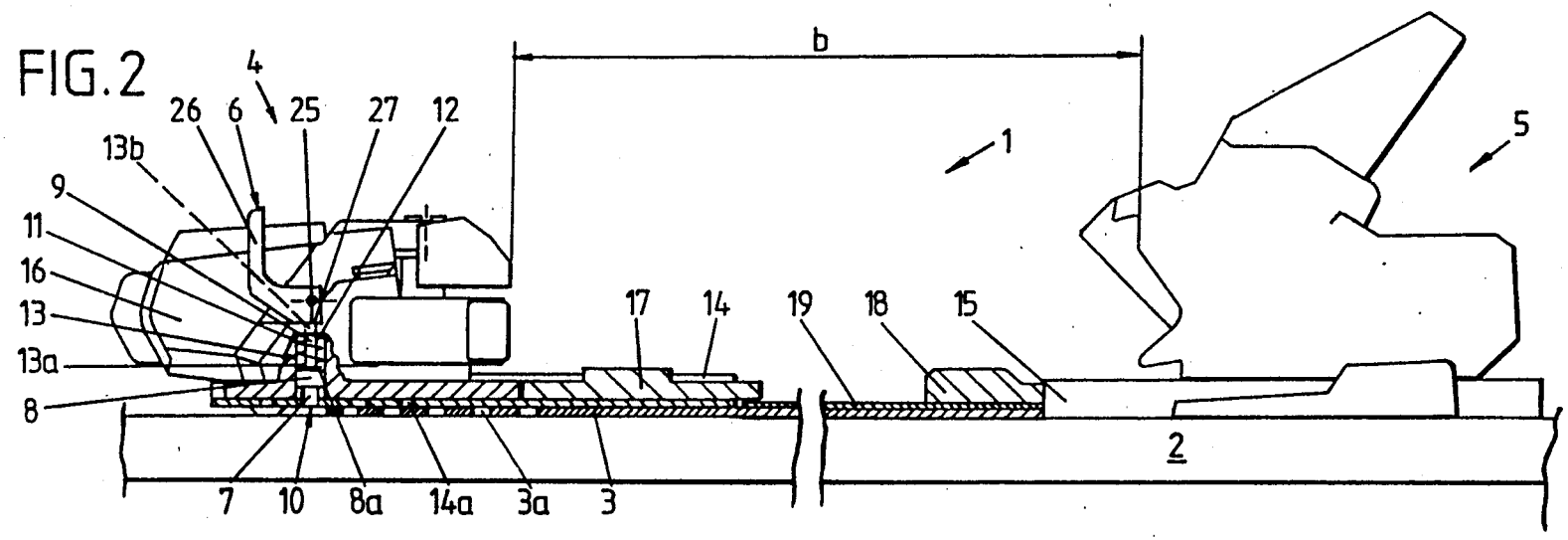
FIG. 2 shows the ski binding, similar to FIG. 1, but with the heel holder being adjustable in a longitudinal direction of the ski.
Figure 3:
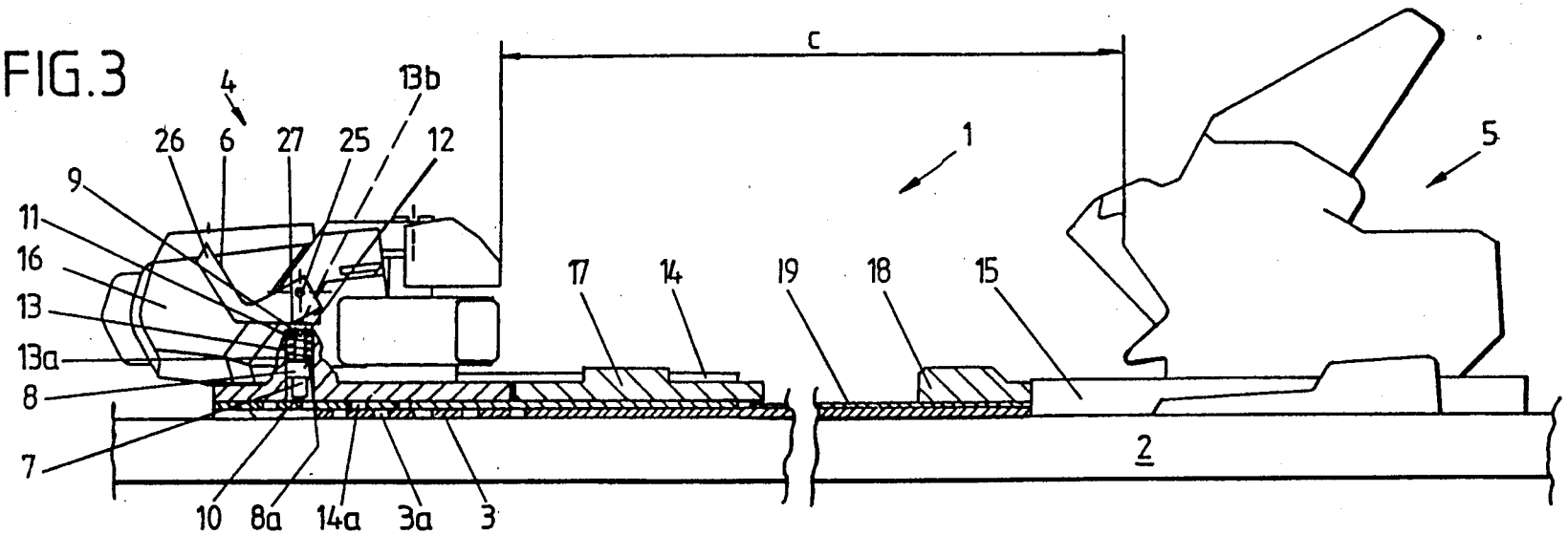
FIG. 3 shows the ski binding, similar to FIG. 1, with the front jaw being in the unlocked position.

FIGS. 1 to 3 identify the entirety of a ski binding by the reference numeral 1, which ski binding is fastened on a ski 2. The ski binding 1 includes a metal band 3 with a front jaw 4 and a heel holder 5. The front jaw 4 is longitudinally adjustably and fixably supported on a ski-fixed front guide rail 14. The heel holder 5 is guided freely movably on a ski-fixed rear guide rail 15 and is prevented from lifting off the ski in an upward direction by the guide rail. The metal band 3 extends in a longitudinal direction of the ski 2. Both the front jaw 4 and also the heel holder 5 can be connected to the metal band 3 in a manner which will be described in greater detail later on. This enables the ski binding 1 to adapt in a conventional manner to different ski boot sizes.

A locking device with an operating member 6 is for this purpose arranged according to the invention in the front jaw 4. Both the front guide rail 14 and also the metal band 3 have locking recesses 14*a* or 3*a* which receive a locking pin 7 therein. The locking pin 7 is thereby connected in one piece with a piston 8, which in turn has a guide rod 9 extending in a direction opposite the locking pin 7, with the locking pin 7, piston 8 and the guide rod 9 thereby forming the locking part 10. The piston 8 is axially guided in a first, lower section 13*a* of a vertical recess 13 in a housing 16 of the front jaw 4. The guide rod 9 has, in a subsequent section 13*b*, a lesser diameter which is guided through the housing 16 of the front jaw 4. A spring 11, designed as a coil spring, is arranged coaxially with respect to the guide rod 9 in the lower section 13*a* of the vertical recess 13. The spring is supported at one end on a first abutment surface 8*a* formed by the upper side of the piston 8 and at the other end on a second bearing surface 12 formed by the housing 16 to effect a loading of the piston 8 in an axial direction. This spring 11 continuously urges the locking part 10 and thus the locking pin 7 against the guide rail 14 and against the metal band 3.

A number of locking recesses 3*a* are provided at the front end of the metal band 3. Also the front guide rail 14 has a number of locking recesses 14*a*. The mentioned skiing position is created by an engagement of the locking pin 7 arranged in the front jaw 4 with one of the locking recesses 3*a* in the metal band 3 and one of the locking recesses 14*a* in the front guide rail 14. To hold the heel holder 5 on the metal band 3, the metal band has a row of teeth thereon; a detent on the heel holder 5 can selectively engage these teeth. This development is known by itself, it is not the subject matter of the present invention and can easily be duplicated by the man skilled in the art without any further details, both with respect to the design and also function.

The guide rod 9 projecting from the housing 16 is connected to an operating member 6 by means of a transversely extending bolt 25. The operating member 6 is thereby designed as a lever-like handle having a handle part 26, with the cross bolt 25 for the locking part 10 being provided at the end opposite the handle part 26. This end of the operating member 6 has furthermore a first surface 28 which rests flatly on an upper side 27 of the housing 16 in the illustrated locked position (see FIGS. 1, 1*a*). A second surface 29 extends at a right angle with respect to the first surface 28, which second surface 29 converges with the first surface 28 through a steep cam 31 of an eccentric. A first support point 32 lies on this steep cam 31, through which support point the operating member 6 can be swung around one time. A third surface 30 follows the second surface 29 at an obtuse angle $\beta$ of 120°-155°, in particular of 140°, and through a further steep cam 33, with a second support point 34 lying on the steep cam 33.

Figure 1A:
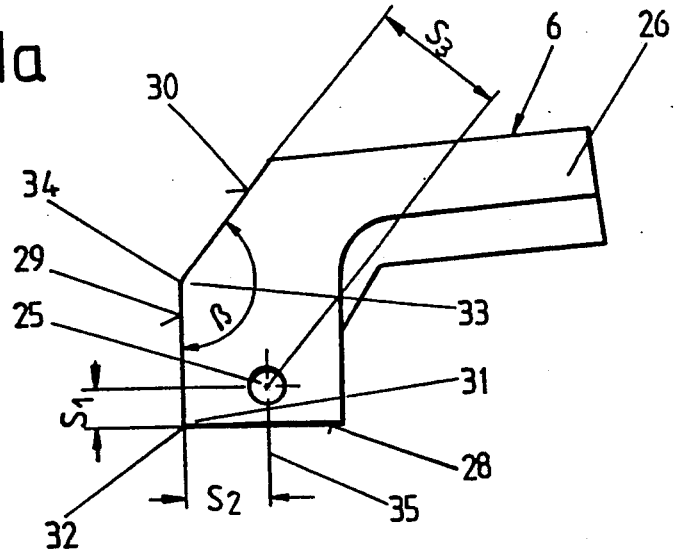
FIG. 1*a* shows an enlarged detail of the front jaw.

The normal distances between the individual surfaces 28, 29, 30 and the cross bolt 25 are identified, respectively, with $S_1$, $S_2$, $S_3$ (see in particular FIG. 1*a*). The difference between the normal distances $S_2$ and $S_1$ corresponds thereby to the thickness of the metal band 3 and the difference between the normal distances $S_3$ and $S_2$ corresponds to the thickness of the front guide rail 14.

The distance between the front jaw 4 and the heel holder 5 is identified by an a in the skiing position of the ski binding 1.

During a first pivoting of the operating member 6 through the first support point 32 into the position according to FIG. 2, the first support point 32 slides on the upper side 27 of the housing 16 in direction of the centerline 35 through the cross bolt 25. As soon as this support point 32 passes through a plane containing this centerline 35, the operating member 6 again moves into a stable position with the second surface 29 now resting on the upper side 27 of the housing 16, as this is illustrated in FIG. 2. The ski binding 1 illustrated in FIG. 2 shows the position in which the locking pin 7, due to the first pivoting of the operating member 6, disengaged from the locking recesses 3*a* in the metal band 3, enables the heel holder 5 connected to the metal band 3 to thus be adjusted to the desired boot size corresponding with the distance b along the rear guide rail 15. During a further pivoting of the operating member 6 through the second support point 34, the third surface 30 will rest on the upper side 27 of the housing 16, as this is illustrated in FIG. 3.

FIG. 3 shows the position in which the locking pin 7, through a further pivoting of the operating member 6 now also disengaged from the locking recesses 14*a* in the front guide rail 14. The front jaw 4 can in this manner be moved in the front guide rail 14 and the heel holder 5 in the rear guide rail 15 and can thus not only be adjusted to the desired boot size c but can also be moved into a centered position relative to the ski. The effect of the locking or rather unlocking is caused by the above-disclosed differences between the normal distances $S_2$–$S_1$ or rather $S_3$–$S_2$.

Figure 4:
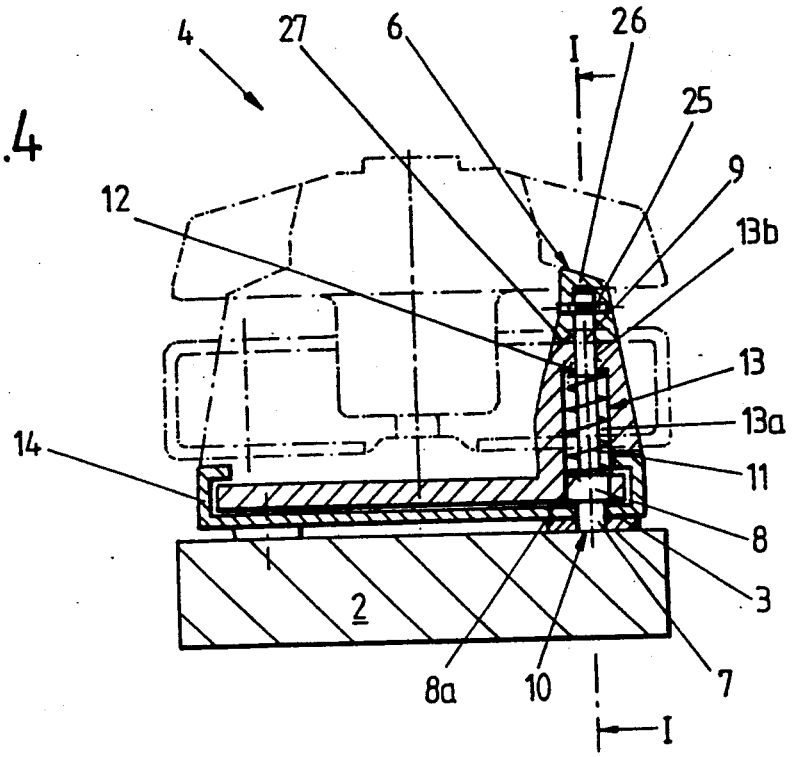
FIG. 4 is a cross-sectional view of the front jaw corresponding to the line IV—IV of FIG. 1.

The operating member 6 is, when the adjusting operation has been concluded, swung in the opposite direction from the unlocking direction and is thus moved into the original position. This position is also shown in FIGS. 1*a* and 4.

The metal band 3 has a coating 19 of a plastic material between the front jaw 4 and the heel holder 5. The metal band 3 has furthermore in its front area a stepping plate 17 (only indicated) and in its rear area a cover 18. These developments are also not part of the subject matter of the invention.

The above information serves only to clarify the application of the invention to a marketable product The embodiments of the invention in which an exclusive property or privilege is claimed are defined as follows:

1. In a ski binding, comprising a guide rail adapted to be fastened on an upper side of a ski, and a jaw unit guided on said guide rail for movement in a longitudinal direction of the ski and being selectively fixed in predetermined positions on said guide rail by a locking device which has a movable locking part supported on said jaw unit and for movement, urged by a force of a spring, into selective reception in one of a plurality of complementary locking recesses in said guide rail, said locking part including an operating member pivotally supported for movement about a pivot axis for facilitating said locking part becoming disengaged from said complementary locking recess, said operating member having at least first and second surfaces each being oriented at a different first and second distance from said pivot axis and thus determining a locked and an unlocked condition of said locking device, said first and second surfaces being held in said locked and unlocked conditions urged by said spring against a complementary surface on said jaw unit, the improvement wherein said operating member includes a further, third surface spaced a still different third distance from said pivot axis, wherein said guide rail includes a front portion and a rear portion, said jaw unit being movably supported on said front portion, a heel holder being movably supported on said rear portion of said guide rail, said heel holder having a metal band extending forwardly thereof to a position underlaying said jaw unit, said metal band and said front portion of said guide rail being in superposed relation, said metal band being movable longitudinally of the ski with said heel holder and relative to said front portion of said guide rail, said heel holder being prevented from lifting away from the ski by said rear portion of said guide rail, wherein said locking part and said operating member together define first and second locking positions, said first locking position effectively locking said jaw unit and said metal band to said front portion of said guide rail, whereas said second locking position effectively locking only said jaw unit to said front portion of said guide rail, said metal band together with said heel holder, in said second locking condition, being movable in said longitudinal direction of the ski and a desired position by said locking device when in said first locking position.

2. The ski binding component according to claim 1, wherein said third surface on said operating member extends through a steep cam at an obtuse angle with respect to said second surface, and wherein a second support point lies on said steep cam.

3. The ski binding component according to claim 1, wherein a difference between said second distance of said second surface from said pivot axis and said first distance of said first surface from said pivot axis is one of greater than and equal to a thickness of said metal band, each said first and second distance being measured along a line perpendicular to a respective first and second surface and said pivot axis.

4. The ski binding component according to claim 1, wherein a difference between said third distance of said third surface from said pivot axis and said second distance of said second surface from said pivot axis is one of greater than and equal to a thickness of said front portion of said guide rail, each said second and third distance being measured along a line perpendicular to a respective second and third surface and said pivot axis.

* * * * *

UNITED STATES PATENT AND TRADEMARK OFFICE

CERTIFICATE OF CORRECTION

PATENT NO. : 5 192 090

DATED : March 9, 1993

INVENTOR(S) : Klaus DAMBORSKY

It is certified that error appears in the above-identified patent and that said Letters Patent is hereby corrected as shown below:

Column 6, line 8; after "ski and" insert ---lockable in---.

Signed and Sealed this

Twenty-third Day of November, 1993

*Attest:*

*Attesting Officer*

BRUCE LEHMAN

*Commissioner of Patents and Trademarks*